US011498819B2

(12) United States Patent
Bruno et al.

(10) Patent No.: US 11,498,819 B2
(45) Date of Patent: Nov. 15, 2022

(54) SCISSOR LIFT ARM INSPECTION PROP

(71) Applicant: Oshkosh Corporation, Oshkosh, WI (US)

(72) Inventors: Benjamin C. Bruno, Oshkosh, WI (US); Devin J. Rosencrance, Oshkosh, WI (US)

(73) Assignee: Oshkosh Corporation, Oshkosh, WI (US)

( * ) Notice: Subject to any disclaimer, the term of this patent is extended or adjusted under 35 U.S.C. 154(b) by 151 days.

(21) Appl. No.: 16/811,092

(22) Filed: Mar. 6, 2020

(65) Prior Publication Data

US 2020/0290855 A1 Sep. 17, 2020

Related U.S. Application Data

(60) Provisional application No. 62/819,209, filed on Mar. 15, 2019.

(51) Int. Cl.
*B66F 17/00* (2006.01)
*B66F 11/04* (2006.01)

(52) U.S. Cl.
CPC ..... *B66F 17/006* (2013.01); *B66F 11/042* (2013.01)

(58) Field of Classification Search
CPC ..... B66F 17/006; B66F 17/00; B66F 11/042; B66F 3/22; B66F 3/245; E04G 1/22
See application file for complete search history.

(56) References Cited

U.S. PATENT DOCUMENTS 198,499 A * 12/1877 Pack ..... B66F 11/042 182/69.5
942,683 A * 12/1909 Vaghi ..... E06C 1/54 52/109
2,945,551 A * 7/1960 Markh ..... B66F 11/042 182/69.5
3,259,369 A * 7/1966 Gridley ..... B66F 7/0666 187/269

(Continued)

FOREIGN PATENT DOCUMENTS

CN 102219172 B 1/2013
CN 105016263 A 11/2015
JP 09-058987 3/1997

OTHER PUBLICATIONS

Foreign Search Report on PCT PCT/US2020/021337 dated Jul. 7, 2020, 15 pps.

*Primary Examiner* — Daniel P Cahn
*Assistant Examiner* — Shiref M Mekhaeil
(74) *Attorney, Agent, or Firm* — Foley & Lardner LLP

(57) ABSTRACT

A lift device includes a base, a platform configured to support an operator, and a scissor assembly coupling the base to the platform. The scissor assembly includes an actuator configured to extend and retract the scissor assembly to move the platform between a fully raised position and a fully lowered position, a first scissor arm pivotally coupled to a second scissor arm, and a prop pivotally coupled to the first scissor arm such that the prop rotates about a lateral axis. The prop is configured to selectively engage an engagement surface defined by at least one of the second scissor arm and a protrusion coupled to the second scissor arm, thereby preventing the platform from reaching the fully lowered position.

13 Claims, 15 Drawing Sheets

(56) References Cited

U.S. PATENT DOCUMENTS 3,891,108 A * 6/1975 Traficant ..... B66F 7/08 414/495
3,926,412 A * 12/1975 Beretta ..... B65D 19/10 256/46
4,995,130 A * 2/1991 Hahn ..... B66F 7/08 14/71.3
5,145,029 A * 9/1992 Blasdell, Jr. ..... E04G 1/22 182/69.5
5,222,717 A * 6/1993 Traficant ..... B66F 7/08 254/122
5,394,959 A * 3/1995 Cullity ..... B66B 9/16 187/244
8,505,684 B1 * 8/2013 Bogue ..... B66F 11/042 182/69.5
10,472,889 B1 11/2019 Betz
10,611,347 B1 4/2020 Archer et al.
10,617,900 B1 4/2020 Linsmeier et al.
2014/0231733 A1 * 8/2014 Hoffman ..... F15B 15/261 254/93 R
2014/0251726 A1 9/2014 Ditty et al.
2015/0175353 A1 * 6/2015 Gillmore ..... B60P 1/003 414/472
2015/0259185 A1 9/2015 Ditty
2016/0311253 A1 10/2016 Palmer et al.
2018/0038517 A1 2/2018 Ditty et al.
2018/0084756 A1 * 3/2018 Bowser ..... B66F 7/065
2018/0215597 A1 8/2018 Linsmeier et al.
2019/0119088 A1 4/2019 Puszkiewicz et al.
2019/0137006 A1 5/2019 Ditty et al.
2019/0322512 A1 10/2019 Puszkiewicz et al.
2019/0359460 A1 11/2019 Linsmeier et al.
2020/0071996 A1 3/2020 Betz
2020/0140248 A1 5/2020 Hackenberg et al.
2020/0140249 A1 5/2020 Hackenberg et al.
2020/0255271 A1 * 8/2020 O'Connell ..... B66F 7/065
2020/0290852 A1 * 9/2020 Rosencrance ..... B66F 7/28
2020/0317256 A1 * 10/2020 Hao ..... B66F 11/042
2021/0278042 A1 * 9/2021 Liang ..... B66F 17/006
2021/0284512 A1 * 9/2021 Peterson ..... B66F 7/08

* cited by examiner

SCISSOR LIFT ARM INSPECTION PROP

CROSS-REFERENCE TO RELATED PATENT APPLICATION

This application claims the benefit of U.S. Provisional Application No. 62/819,209, filed Mar. 15, 2019, which is incorporated herein by reference in its entirety.

BACKGROUND

Certain aerial work platforms, known as scissor lifts, include a frame assembly that supports a platform. The platform is coupled to the frame assembly using a system of linked supports arranged in a crossed pattern, forming a scissor assembly. As the supports rotate relative to one another, the scissor assembly extends or retracts, raising or lowering the platform relative to the frame. Accordingly, the platform moves primarily or entirely vertically relative to the frame assembly. Scissor lifts are commonly used where scaffolding or a ladder might be used, as they provide a relatively large platform from which to work that can be quickly and easily adjusted to a broad range of heights. Scissor lifts are commonly used for painting, construction projects, accessing high shelves, changing lights, and maintaining equipment located above the ground.

SUMMARY

One embodiment relates to a lift device including a base, a platform configured to support an operator, and a scissor assembly coupling the base to the platform. The scissor assembly includes an actuator configured to extend and retract the scissor assembly to move the platform between a fully raised position and a fully lowered position, a first scissor arm pivotally coupled to a second scissor arm, and a prop pivotally coupled to the first scissor arm such that the prop rotates about a lateral axis. The prop is configured to selectively engage an engagement surface defined by at least one of the second scissor arm and a protrusion coupled to the second scissor arm, thereby preventing the platform from reaching the fully lowered position.

Another embodiment relates to a lift device including a base, a platform configured to support an operator, and a scissor assembly coupling the base to the platform. The scissor assembly includes an actuator configured to extend and retract the scissor assembly to move the platform between a fully raised position and a fully lowered position, a first scissor arm pivotally coupled to a second scissor arm about a middle axis that extends laterally, a first rod coupled to the first scissor arm and aligned with a first lateral axis, a second rod coupled to the second scissor arm and aligned with a second lateral axis, and a prop pivotally coupled to the first rod such that the prop rotates about the first lateral axis. The prop is configured to selectively engage the second rod to limit downward movement of the platform. A straight line is defined between the first lateral axis and the second lateral axis, and a center of gravity of the prop is offset from the straight line when the prop engages the second rod.

Still another embodiment relates to a lift device including a base, a platform configured to support an operator, and a scissor assembly coupling the base to the platform. The scissor assembly includes an actuator configured to extend and retract the scissor assembly to move the platform between a fully raised position and a fully lowered position, a first scissor arm pivotally coupled to a second scissor arm about a middle axis, a third scissor arm pivotally coupled to a lower end of the of the first scissor arm about a first end axis, a fourth scissor arm pivotally coupled to an upper end of the second scissor arm about a second end axis, a first rod coupled to the first scissor arm and extending along the first end axis, a second rod coupled to the second scissor arm and extending along the second end axis, and a prop pivotally coupled to the first rod such that the prop rotates about the first end axis. The prop is configured to selectively engage the second rod, thereby preventing the platform from reaching the fully lowered position. The second rod is positioned above the first rod such that the prop extends upward from the first rod when the prop engages the second rod.

The invention is capable of other embodiments and of being carried out in various ways. Alternative exemplary embodiments relate to other features and combinations of features as may be recited herein.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
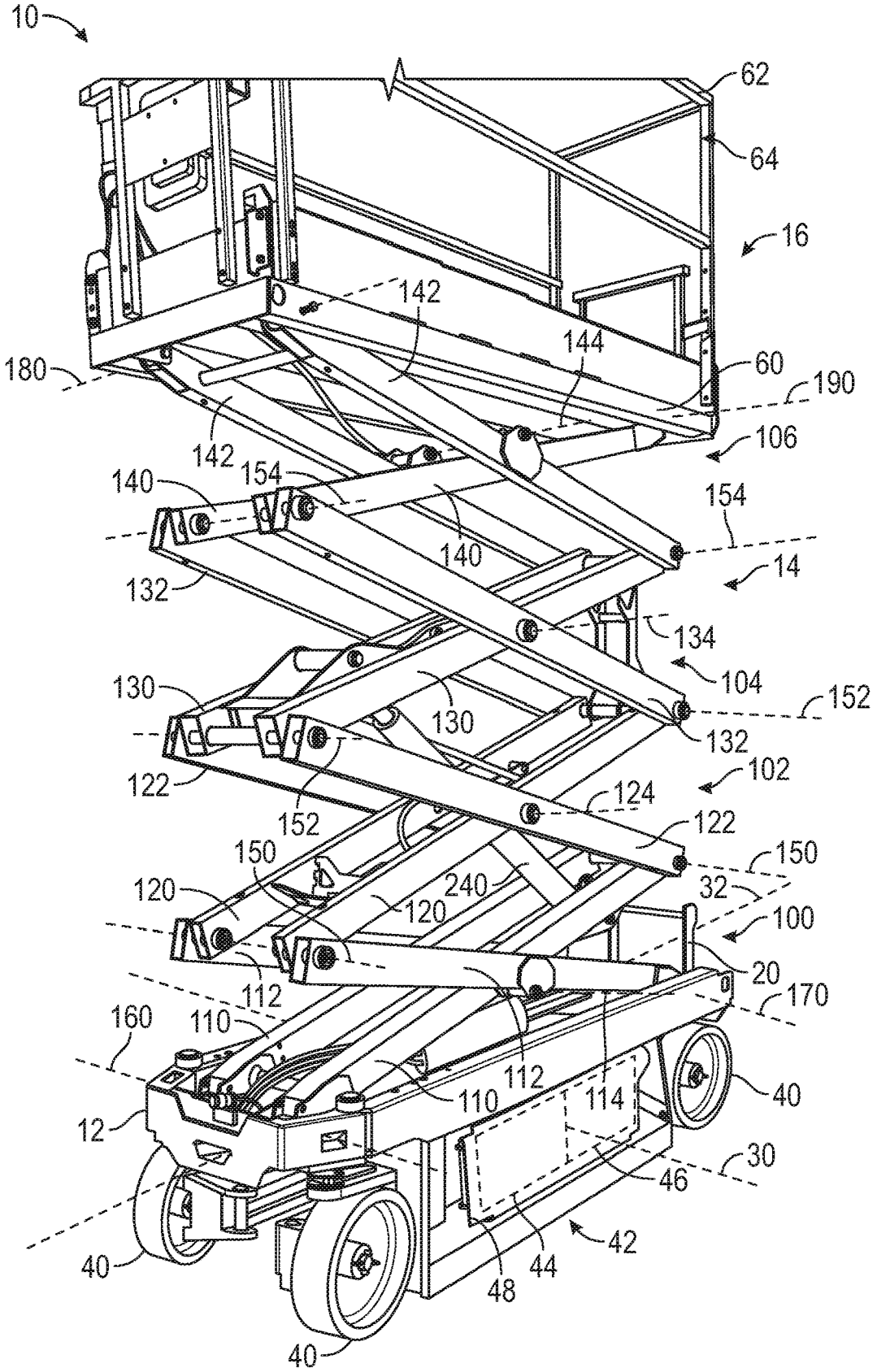
FIG. 1 is a perspective view of a lift device, according to an exemplary embodiment.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

According to an exemplary embodiment, a scissor lift includes a base, a platform configured to support at least one operator, and a lift assembly coupled to the base and the platform and configured to raise and lower the platform relative to the base. The lift assembly includes a series of scissor layers arranged on top of one another. Each scissor layer includes a pair of inner scissor arms pivotally coupled to a pair of outer scissor arms. The inner scissor arms of each scissor layer are pivotally coupled to the outer scissor arms of the adjacent scissor layers with a stowed position rod. The bottom scissor layer is coupled to the base, and the top scissor layer is coupled to the platform. One or more actuators rotate the scissor arms relative to one another such that the overall length of the scissor assembly changes, raising and lowering the platform.

When maintaining certain parts of a scissor lift, it is desirable to maintain the lift assembly in a partially extended position (e.g., corresponding to a partially raised position of the platform) to facilitate access to certain parts of the scissor lift (e.g., an actuator positioned between the inner scissor arms, etc.). Such maintenance procedures may cause the actuators to release some or all of the force that they exert to hold the lift assembly in the partially extended position. By way of example, the maintenance procedure may call for part of a hydraulic circuit powering the actuator to be drained of hydraulic fluid. Accordingly, it is desirable to have a secondary system for holding the lift assembly in the partially extended position without requiring a continuous force from the actuators.

The lift assembly further includes a prop pivotally coupled to one of the scissor arms. The prop defines a recess that is configured to receive a protrusion extending from one of the scissor arms positioned above the prop. Along an edge of the recess, the prop defines a first engagement surface that engages a second engagement surface of the protrusion that is received by the recess. When the first engagement surface and the second engagement surface engage one another, the prop spaces the scissor arms apart from one another, preventing the lift assembly from reaching a fully retracted position and thereby preventing the platform from reaching a fully lowered position. The prop is selectively repositionable between a stowed position and a deployed position. In the stowed position, the prop is rotated downward and away from the second engagement surface. In the deployed position, the prop is rotated upward and toward the second engagement surface such that the first engagement surface will engage the second engagement surface when the platform is moved downward. A loaded position is located between the stowed position and the deployed position. The geometry of the recess is configured (e.g., tapered) such that the prop automatically moves to the loaded position when the platform is fully supported by the prop.

The lift assembly further includes a stop having a first stop surface and a second stop surface. The stop is fixedly coupled to one of the outer scissor arms. The prop engages the first stop surface when in the deployed position, and the prop engages the second stop surface when in the stowed position. Accordingly, the stop limits the position of the prop to between the stowed position and the deployed position. The center of gravity of the prop is positioned longitudinally inward of the axis of rotation of the prop when the prop is in the stowed position and longitudinally outward of an axis of rotation of the prop when the prop is in the deployed position. Accordingly, the force of gravity acting on the center of gravity biases the prop to stay in the stowed position when in the stowed position and biases the prop to stay in the deployed position when in the deployed position. This permits a user to simply raise the prop prior to performing maintenance, and the weight of the prop acting against the stop holds the prop in place until the first and second engagement surfaces contact one another.

Figure 2:
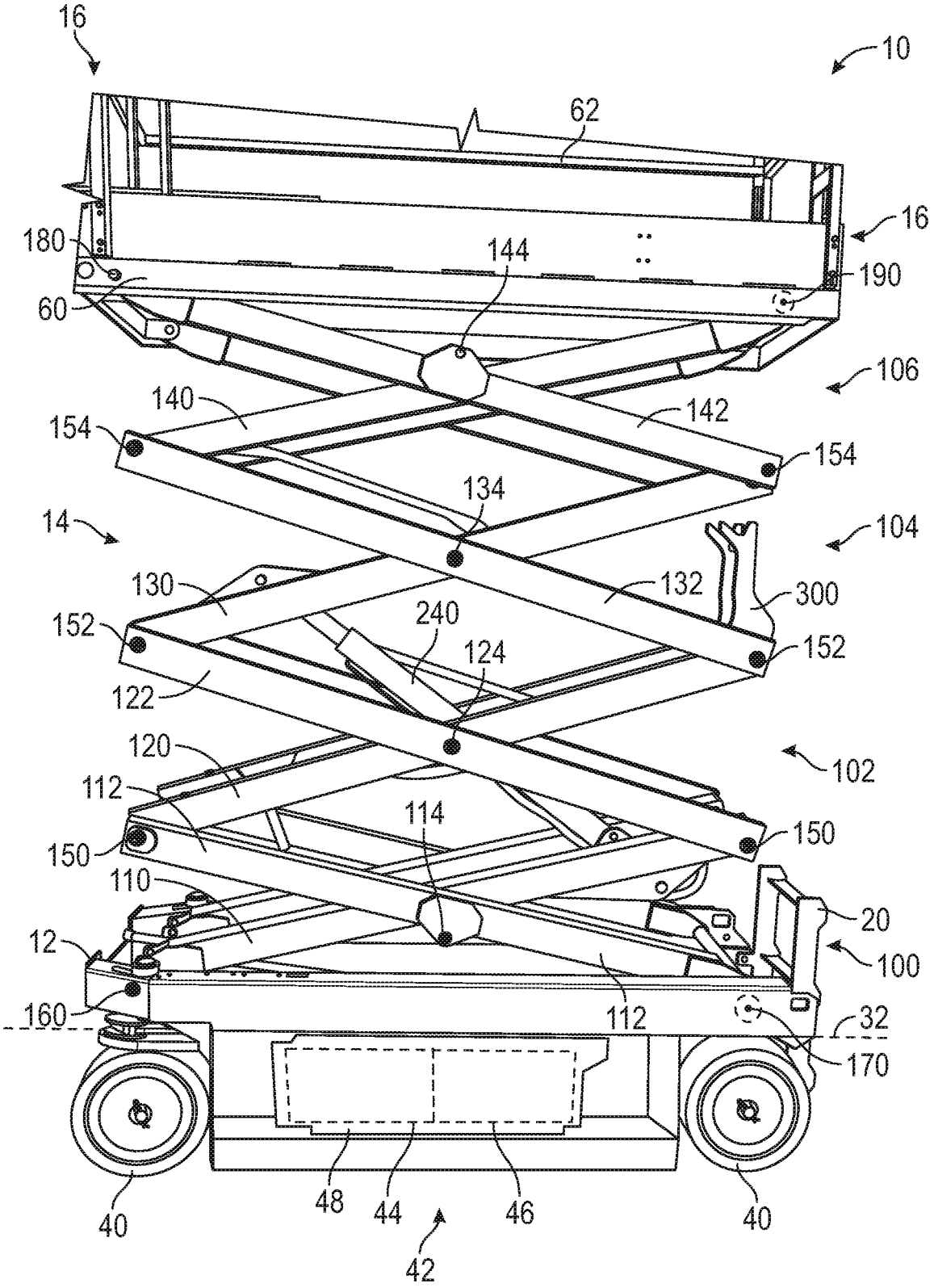
FIG. 2 is a front view of the lift device of FIG. 1.

According to the exemplary embodiment shown in FIGS. 1 and 2, a lift device (e.g., a scissor lift, an aerial work platform), shown as lift device 10, includes a chassis or base, shown as frame assembly 12. A lift device (e.g., a scissor assembly), shown as lift assembly 14, couples the frame assembly 12 to a work platform, shown as platform 16. The frame assembly 12 supports the lift assembly 14 and the platform 16, both of which are disposed directly above the frame assembly 12. In use, the lift assembly 14 extends and retracts to raise and lower the platform 16 relative to the frame assembly 12 between a fully lowered position and a fully raised position. The lift device 10 includes an access assembly, shown as an access assembly 20, that is coupled to the frame assembly 12 and configured to facilitate access to the platform 16 from the ground by an operator when the platform 16 is in the fully lowered position.

Referring again to FIGS. 1 and 2, the frame assembly 12 defines a horizontal plane having a lateral axis 30 and a longitudinal axis 32. In some embodiments, the frame assembly 12 is rectangular, defining sides extending parallel to the lateral axis 30 and sides extending parallel to the longitudinal axis 32. In some embodiments, the frame assembly 12 is longer in a longitudinal direction than in a lateral direction. In some embodiments, the lift device 10 is configured to be stationary or semi-permanent (e.g., a system that is installed in one location at a work site for the duration of a construction project). In such embodiments, the frame assembly 12 may be configured to rest directly on the ground and/or the lift device 10 may not provide powered movement across the ground. In other embodiments, the lift device 10 is configured to be moved frequently (e.g., to work on different tasks, to continue the same task in multiple locations, to travel across a job site, etc.). Such embodiments may include systems that provide powered movement across the ground.

The lift device 10 is supported by a plurality of tractive assemblies 40, each including a tractive element (e.g., a tire, a track, etc.), that are rotatably coupled to the frame assembly 12. The tractive assemblies 40 may be powered or unpowered. As shown in FIG. 1, the tractive assemblies 40 are configured to provide powered motion in the direction of the longitudinal axis 32. One or more of the tractive assemblies 40 may be turnable or steerable to steer the lift device 10. In some embodiments, the lift device 10 includes a powertrain system 42. In some embodiments, the powertrain system 42 includes a primary driver 44 (e.g., an engine, an electric motor, etc.). A transmission may receive mechanical energy from the primary driver and provide an output to one or more of the tractive assemblies 40. In some embodiments, the powertrain system 42 includes a pump 46 configured to receive mechanical energy from the primary driver 44 and output a pressurized flow of hydraulic fluid. The pump 46 may supply mechanical energy (e.g., through a pressurized flow of hydraulic fluid) to individual motive drivers (e.g., hydraulic motors) configured to facilitate independently driving each of the tractive assemblies 40. In other embodiments, the powertrain system 42 includes an energy storage device (e.g., a battery, capacitors, ultra-capacitors, etc.) and/or is electrically coupled to an outside source of electrical energy (e.g., a power outlet connected to a power grid). In some such embodiments, one or more of the tractive assemblies 40 include an individual motive driver (e.g., a motor that is electrically coupled to the energy storage device, a hydraulic motor fluidly coupled to the pump 46 etc.) configured to facilitate independently driving one or more of the tractive assemblies 40. The outside source of electrical energy may charge the energy storage device or power the motive drivers directly. The powertrain system 42 may additionally or alternatively provide mechanical energy (e.g., using the pump 46, by supplying electrical energy, etc.) to one or more actuators of the lift device 10 (e.g., a leveling actuator, the lift actuator 240, etc.). One or more components of the powertrain system 42 may be housed in an enclosure, shown as housing 48. The housing 48 is coupled to the frame assembly 12 and extends from a side of the lift device 10 (e.g., a left or right side). The housing 48 may include one or more doors to facilitate access to components of the powertrain system 42.

Referring to FIG. 1, the platform 16 includes a support surface, shown as deck 60, defining a top surface configured to support operators and/or equipment and a bottom surface opposite the top surface. The bottom surface and/or the top surface extend in a substantially horizontal plane. A thickness of the deck 60 is defined between the top surface and the bottom surface. The bottom surface is coupled to a top end of the lift assembly 14. In some embodiments, the deck 60 is rectangular. In some embodiments, the deck 60 has a footprint that is substantially similar to that of the frame assembly 12.

A series of guards or railings, shown as guard rails 62, extend upwards from the deck 60. The guard rails 62 extend around an outer perimeter of the deck 60, partially or fully enclosing a supported area on the top surface of the deck 60 that is configured to support operators and/or equipment. The guard rails 62 provide a stable support for the operators to hold and facilitate containing the operators and equipment within the supported area. The guard rails 62 define one or more openings 64 through which the operators can access the deck 60. The opening 64 may be a space between two guard rails 62 along the perimeter of the deck 60, such that the guard rails 62 do not extend over the opening 64. Alternatively, the opening 64 may be defined in a guard rail 62 such that the guard rail 62 extends across the top of the opening 64. In some embodiments, the platform 16 includes a door that selectively extends across the opening 64 to prevent movement through the opening 64. The door may rotate (e.g., about a vertical axis, about a horizontal axis, etc.) or translate between a closed position and an open position. In the closed position, the door prevents movement through the opening 64. In the open position, the door does not prevent movement through the opening 64.

The access assembly 20 is coupled to a side of the frame assembly 12. As shown in FIG. 2, the access assembly 20 is a ladder assembly. The access assembly 20 is aligned with the opening 64 such that, when the platform 16 is in the lowered position, the access assembly 20 facilitates access to the upper surface of the deck 60 through the opening 64.

The lift assembly 14 is configured to extend and retract, raising and lowering the platform 16 relative to the frame assembly 12. The lift assembly 14 is selectively repositionable between a fully retracted position and a fully extended position. The fully retracted position corresponds to a fully lowered position of the platform 16. The fully lowered position may be used by an operator when entering or exiting the platform 16 (e.g., using the access assembly 20) or when transporting the lift device 10. The fully extended position corresponds to a fully raised position of the platform 16. The fully raised position and any positions between the fully raised position and the fully lowered position may be used by the operator when accessing an elevated area (e.g., to perform construction work, to visually inspect an elevated object, etc.).

Referring to FIGS. 1-4, the lift assembly 14 includes a series of subassemblies, shown as scissor layers. Specifically, the lift assembly 14 includes a first scissor section, shown as bottom scissor layer 100, a pair of second scissor sections, shown as middle scissor layers 102 and 104, and a third scissor section, shown as top scissor layer 106. In other embodiments, the lift assembly 14 includes more or fewer middle scissor layers (e.g., zero, three, etc.). The bottom scissor layer 100 is directly coupled to the frame assembly 12 and to the middle scissor layer 102. The middle scissor layer 102 is directly coupled to the bottom scissor layer 100 and the middle scissor layer 104. The middle scissor layer 104 is directly coupled to the middle scissor layer 102 and the top scissor layer 106. The top scissor layer 106 is directly coupled to the platform 16 and to the middle scissor layer 104.

Each of the scissor layers includes a pair of first scissor arms or scissor members (e.g., tubular members, solid members, etc.), shown as inner arms, and a pair of second scissor arms or scissor members (e.g., tubular members, solid members, etc.), shown as outer arms. Each inner arm is coupled (e.g., fixedly) to the other inner arm within that scissor layer. Each outer arm is coupled (e.g., fixedly) to the other outer arm within that scissor layer. The inner arms of each scissor layer are pivotally coupled (e.g., by one or more pins or rods) to the corresponding outer arms of that scissor layer near the centers of both the inner arms and the outer arms. Accordingly, the inner arms of each layer pivot relative to the outer arms of that scissor layer about a lateral axis. Specifically, the bottom scissor layer 100 includes inner arms 110 and outer arms 112 that pivot relative to one another about a lateral axis, shown as middle axis 114. The middle scissor layer 102 includes inner arms 120 and outer arms 122 that pivot relative to one another about a lateral axis, shown as middle axis 124. The middle scissor layer 104 includes inner arms 130 and outer arms 132 that pivot relative to one another about a lateral axis, shown as middle axis 134. The top scissor layer 106 includes inner arms 140 and outer arms 142 that pivot relative to one another about a lateral axis, shown as middle axis 144.

The scissor layers are stacked atop one another to form the lift assembly 14. Each pair of inner arms and each pair of outer arms has a top end and a bottom end. The ends of the inner arms and the outer arms are pivotally coupled (e.g., by one or more pins or rods) to the adjacent ends of the inner or outer arms of the adjacent scissor layers. Each set of inner arms is directly pivotally coupled to one or more sets of outer arms. This facilitates spacing each pair of inner arms a first distance apart from one another and spacing each pair of outer arms a second distance apart from one another, where the second distance is greater than the first distance. This facilitates ensuring that the fully lowered position is as low as possible, increasing the accessibility of the platform 16 and making the lift device 10 more compact.

The upper ends of the outer arms 112 are pivotally coupled to the lower ends of the inner arms 120 such that they rotate relative to one another about a lateral axis, shown as end axis 150. The upper ends of the inner arms 110 are pivotally coupled to the lower ends of the outer arms 122 such that they rotate relative to one another about another end axis 150. The upper ends of the outer arms 122 are pivotally coupled to the lower ends of the inner arms 130 such that they rotate relative to one another about a lateral axis, shown as end axis 152. The upper ends of the inner arms 120 are pivotally coupled to the lower ends of the outer arms 132 such that they rotate relative to one another about another end axis 152. The upper ends of the outer arms 132 are pivotally coupled to the lower ends of the inner arms 140 such that they rotate relative to one another about a lateral axis, shown as end axis 154. The upper ends of the inner arms 130 are pivotally coupled to the lower ends of the outer arms 142 such that they rotate relative to one another about another end axis 154.

Figure 5:
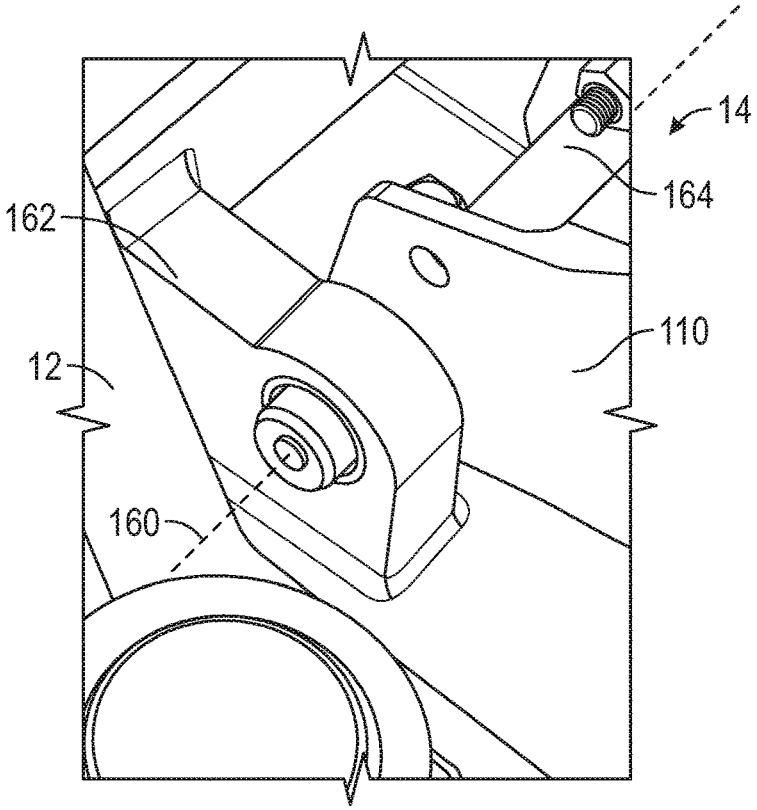
FIG. 5 is a perspective view of a frame and a lift assembly of the lift device of FIG. 1.

Referring to FIG. 5, the lower ends of the inner arms 110 are pivotally coupled to the frame assembly 12 such that the inner arms 110 rotate about a lateral axis, shown as end axis 160. The end axis 160 is fixed to the frame assembly 12 such that the lower ends of the inner arms 110 are translationally fixed relative to the frame assembly 12. A pair of bosses, shown as bearing blocks 162, are coupled (e.g., welded, fastened, etc.) to the frame assembly 12. The bearing blocks 162 are each configured to receive a rod or pin, shown as pin 164. The bearing blocks 162 and the pins 164 may be configured to facilitate rotation of the pins 164 about the end axis 160. The pins 164 each extend along the end axis 160 through one of the bearing blocks 162 and the corresponding inner arms 110. The pins 164 and the bearing blocks 162 pivotally couple the inner arms 110 to the frame assembly 12.

Figure 6:
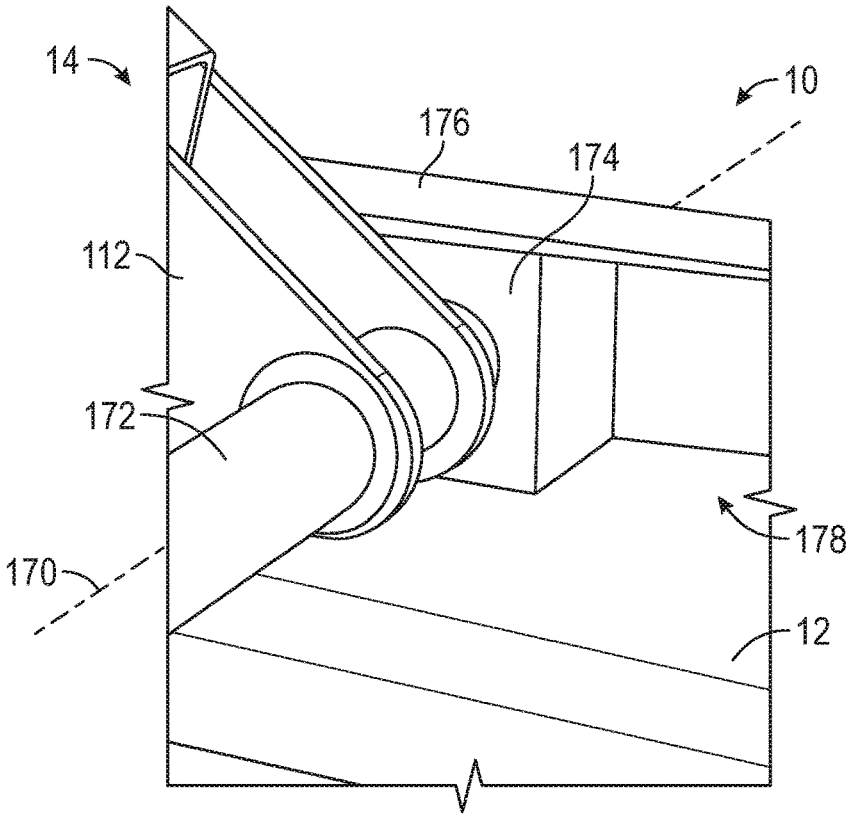
FIG. 6 is another perspective view of the frame and the lift assembly of FIG. 5.

Referring to FIG. 6, the lower ends of the outer arms 112 are pivotally and slidably coupled to the frame assembly 12 such that the outer arms 112 rotate about a lateral axis, shown as end axis 170. The end axis 170 is translatable longitudinally relative to the frame assembly 12 such that the lower ends of the outer arms 112 are slidable longitudinally relative to the frame assembly 12. A tubular member, shown as rod 172, extends laterally between both of the outer arms 112. The rod 172 is coupled (e.g., welded, fastened, etc.) to the outer arms 112. The rod 172 further extends laterally outside of the outer arms 112. Each end of the rod 172 is received within an aperture defined by a block, shown as sliding block 174. The sliding blocks 174 are accordingly pivotally coupled to the rod 172. A pair of frame members, shown as channels 176 are coupled to (e.g., fastened to, welded to, integrally formed with, etc.) the frame assembly 12. The channels 176 extend longitudinally along the frame assembly 12. The channels 176 each define a recess 178 that receives the sliding block 174. Each of the recesses 178 face toward a longitudinal centerline of the lift device 10 such that the sliding blocks 174 are captured laterally by the channels 176. The sliding blocks 174 are free to translate longitudinally along the channels 176 to permit pivoting of the outer arms 112 relative to the inner arms 110.

Figure 3:
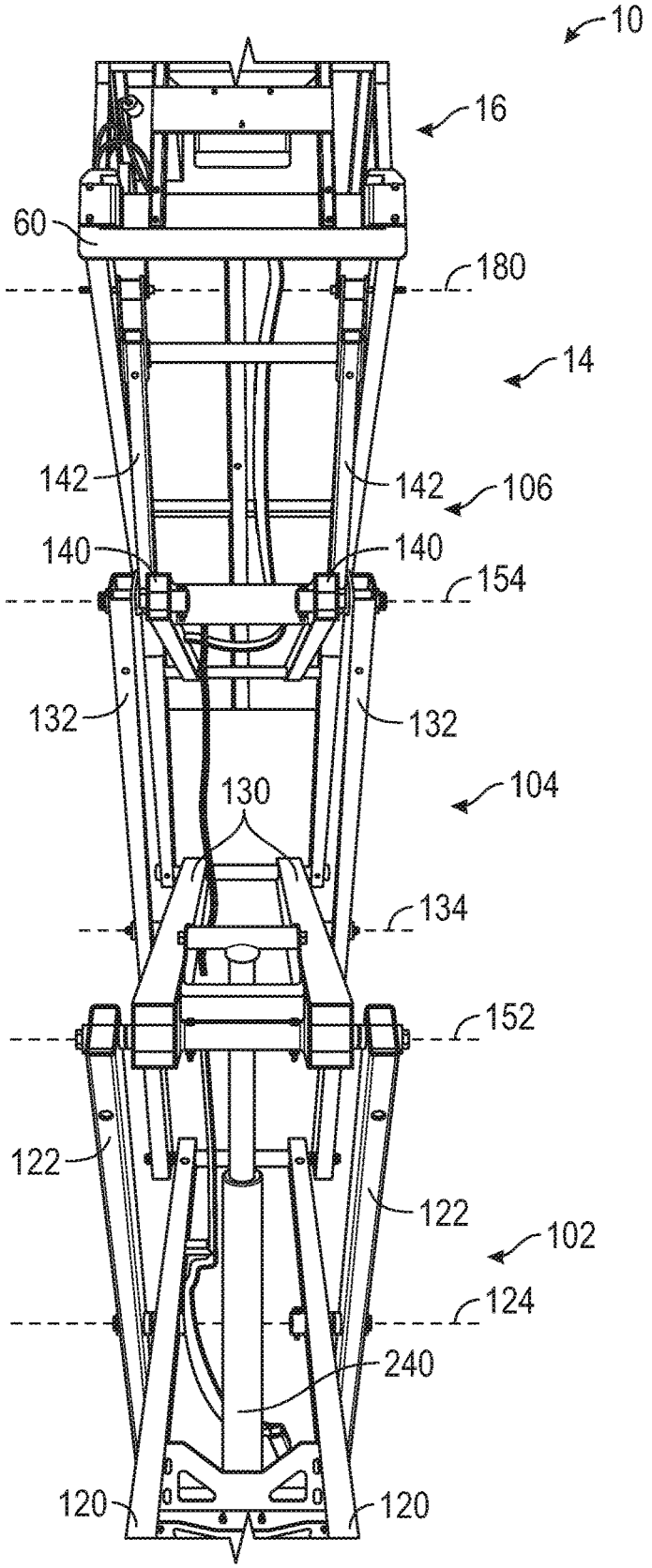
FIG. 3 is a left side view of the lift device of FIG. 1.
Figure 4:
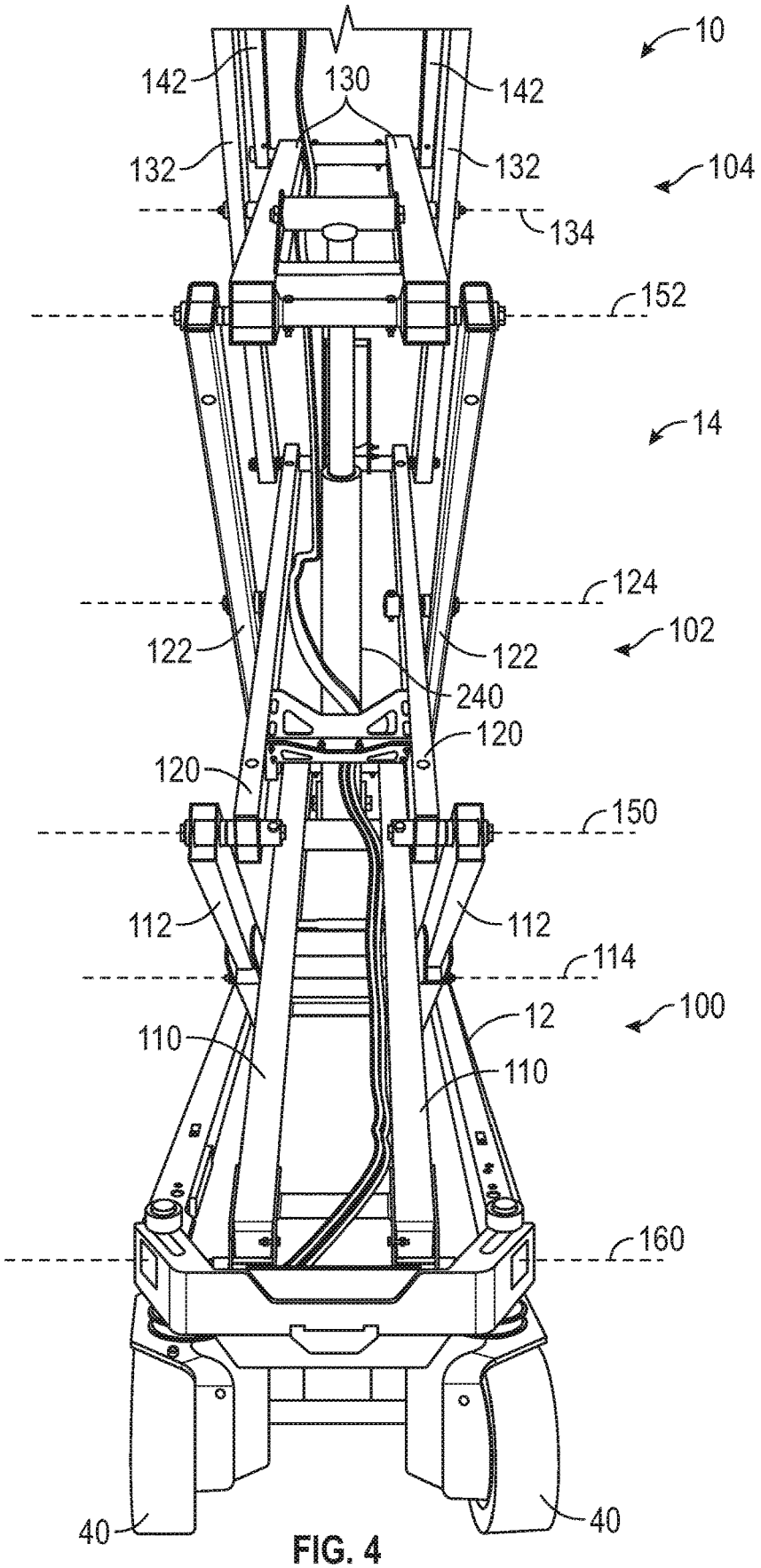
FIG. 4 is another left side view of the lift device of FIG. 1.

Referring to FIG. 3, the upper ends of the outer arms 142 are pivotally coupled to the deck 60 of the platform 16 such that the outer arms 142 rotate about a lateral axis, shown as end axis 180. The end axis 180 is fixed to the platform 16 such that the upper ends of the outer arms 142 are translationally fixed relative to the platform 16. In one embodiment, a pair of pins couple the outer arms 142 to the platform 16. The pins may each extend along the end axis 180 through one of the outer arms 142 and a portion of the deck 60.

Figure 7:
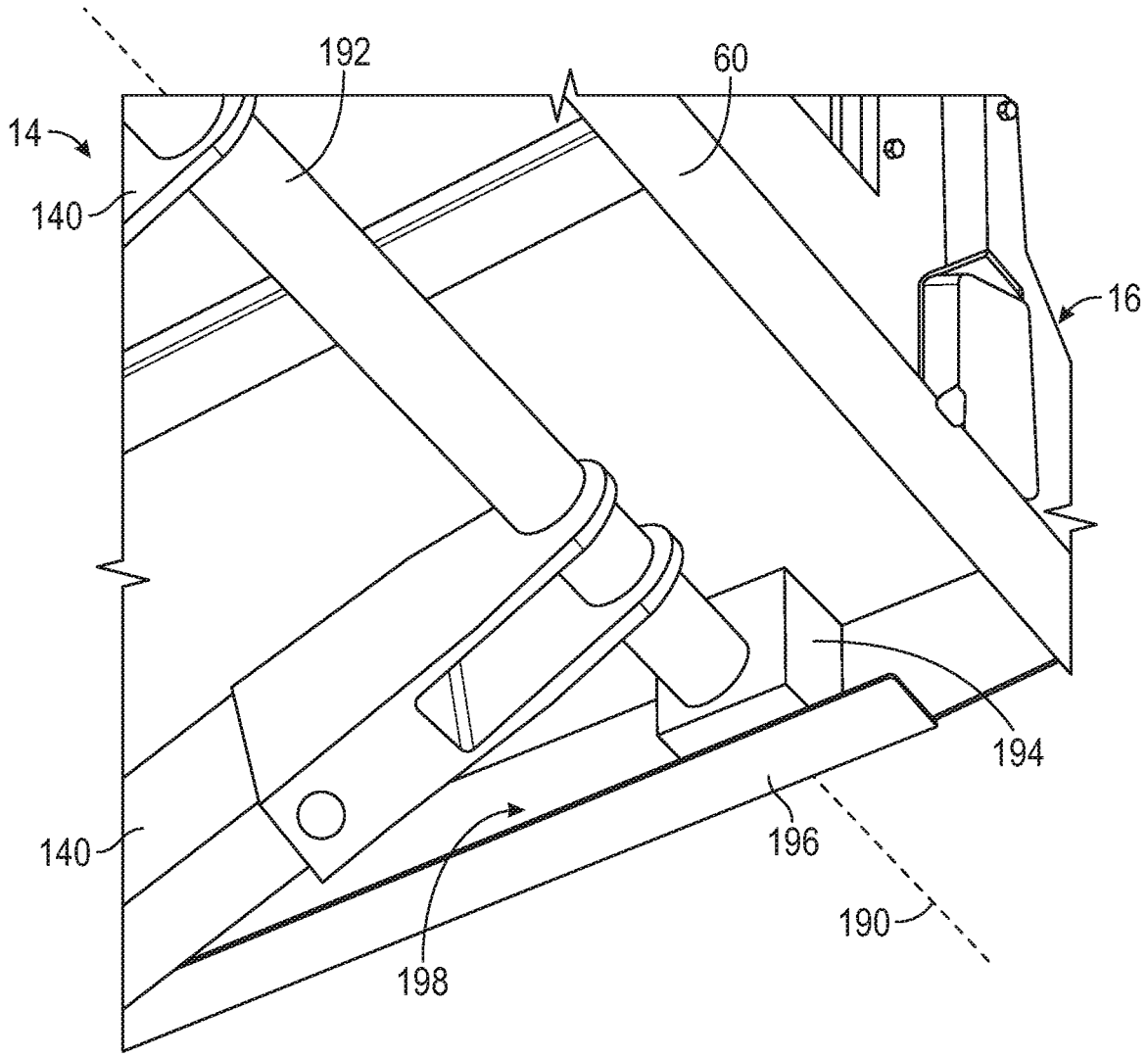
FIG. 7 is a perspective view of a platform of the lift device of FIG. 1 and the lift assembly of FIG. 5.

Referring to FIG. 7, the upper ends of the inner arms 140 are pivotally and slidably coupled to the platform 16 such that the inner arms 140 rotate about a lateral axis, shown as end axis 190. The end axis 190 is translatable longitudinally relative to the platform 16 such that the upper ends of the inner arms 140 are slidable longitudinally relative to the platform 16. A tubular member, shown as rod 192, extends laterally between both of the inner arms 140. The rod 192 is coupled (e.g., welded, fastened, etc.) to the inner arms 140. The rod 192 further extends laterally outside of the inner arms 140. Each end of the rod 192 is received within an aperture defined by a block, shown as sliding block 194. The sliding blocks 194 are accordingly pivotally coupled to the rod 192. A pair of frame members, shown as channels 196 are coupled (e.g., fastened, welded, integrally formed with, etc.) to the frame assembly 12. The channels 196 extend longitudinally along the platform 16. The channels 196 each define a recess 198 that receives the sliding block 194. Each of the recesses 198 face toward a longitudinal centerline of the lift device 10 such that the sliding blocks 194 are captured laterally by the channels 196. The sliding blocks 194 are free to translate longitudinally along the channels 196 to permit pivoting of the inner arms 140 relative to the outer arms 142.

Figure 8:
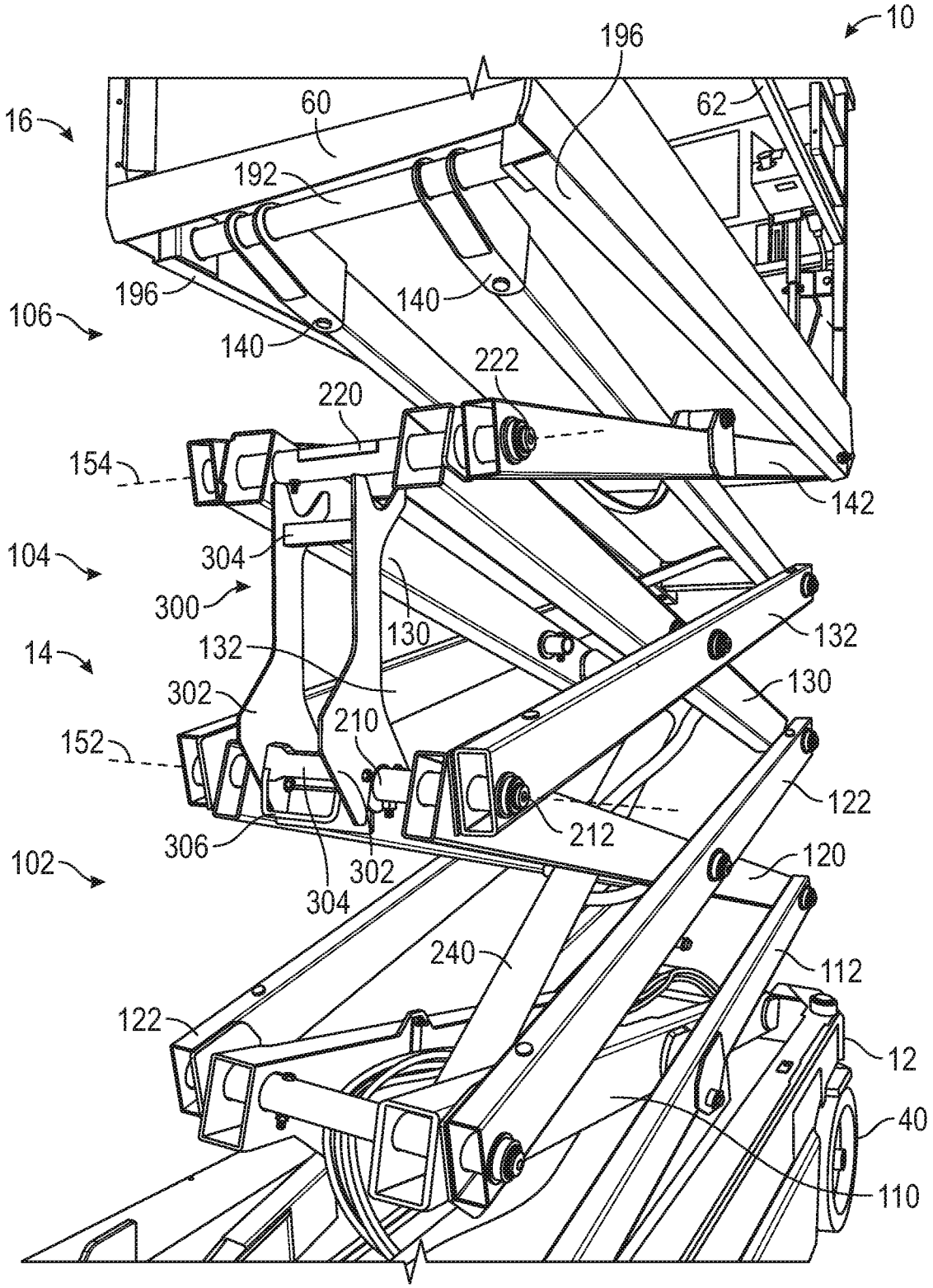
FIG. 8 is a perspective view of an arm inspection prop of the lift assembly of FIG. 5 in a deployed position.
Figure 9:
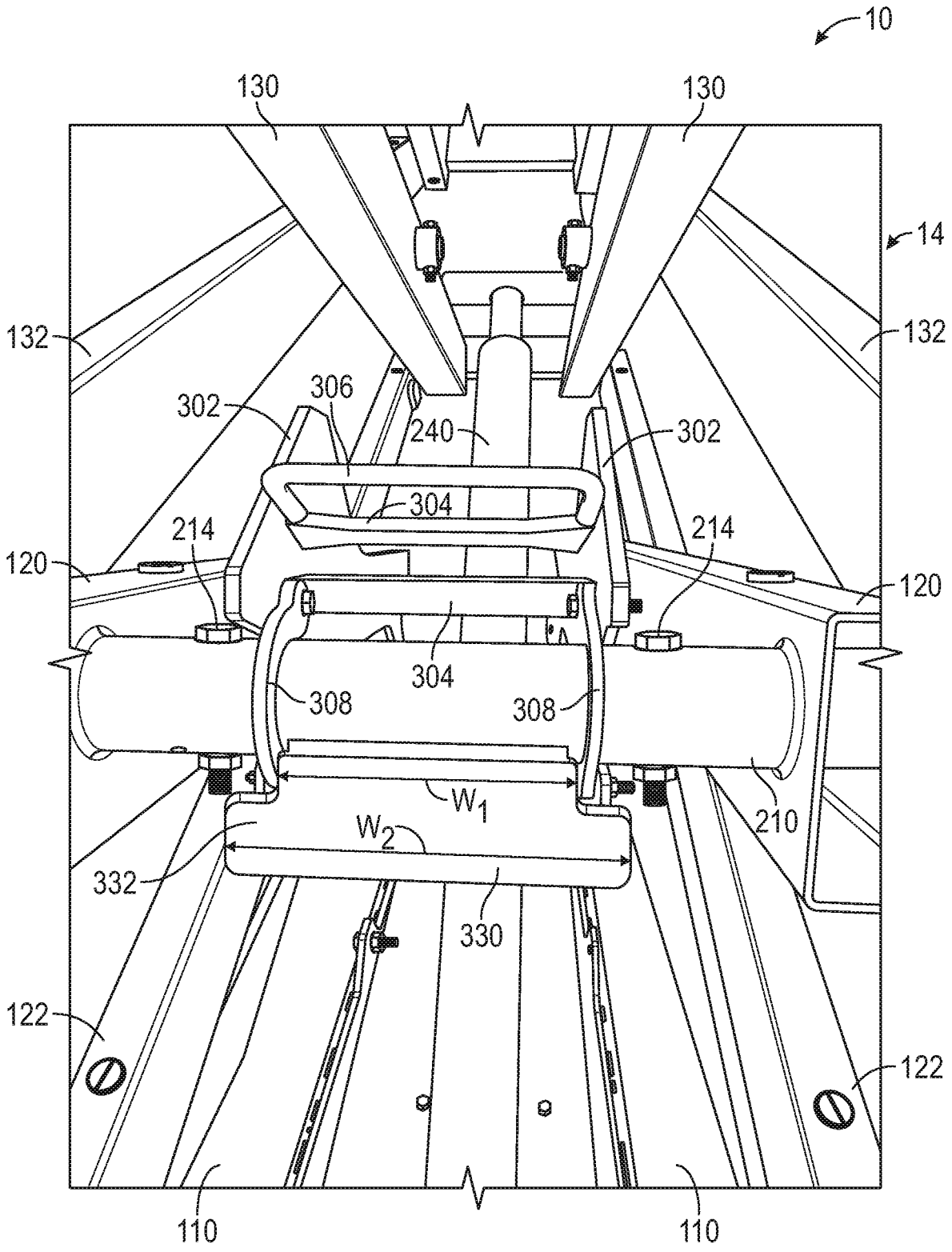
FIG. 9 is a perspective view of the arm inspection prop of FIG. 8 in a stowed position.

Referring to FIGS. 8 and 9, the lift assembly 14 includes a projection, protrusion, support, or member, shown as rod 210. The rod 210 extends laterally between the inner arms 120. The rod 210 is coupled (e.g., fastened, welded, etc.) to the inner arms 120. Specifically, in the embodiment shown in FIGS. 8 and 9, the inner arms 120 have a rectangular tubular cross section defining two vertical sidewalls. The rod 210 extends through the vertical sidewalls and is welded in place, fixedly coupling the inner arms 120 together. The rod 210 has a substantially circular cross section and defines an aperture extending laterally therethrough. On each side of the lift assembly 14, a rod or pin 212 extends through an aperture defined by the outer arm 132 and an aperture defined by the inner arm 120 and is received within the aperture of the rod 210. The pins 212 pivotally couple the outer arms 132 and the inner arms 120 to the rod 210. A pin or fastener, shown as fastener 214, at least selectively fixes the pin 212 to the rod 210. The pin 212 may include a retaining ring (e.g., a snap ring, an E clip, etc.) or a machined shoulder that captures the outer arm 132, preventing it from moving laterally outward. The rod 210 extends substantially parallel to the end axis 152. In the embodiment shown in FIG. 8, the rod 210 is aligned with (e.g., centered about) the end axis 152.

Figure 10:
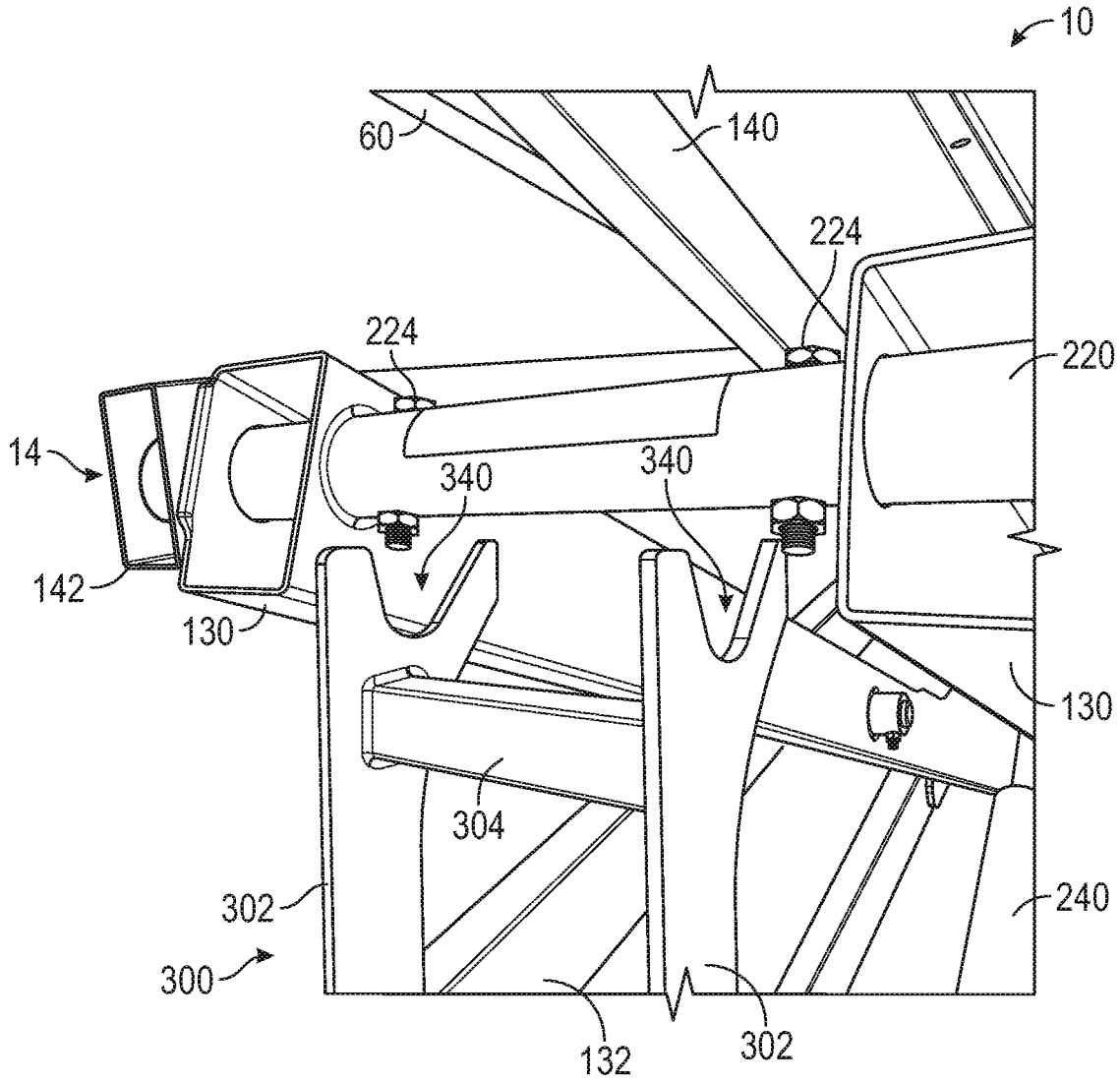
FIG. 10 is another perspective view of the arm inspection prop of FIG. 8 in the deployed position.

Referring to FIGS. 8 and 10, the lift assembly 14 includes a projection, protrusion, support, or member, shown as rod 220. The rod 220 extends laterally between the inner arms 130. The rod 220 is coupled (e.g., fastened, welded, etc.) to the inner arms 130. Specifically, in the embodiment shown in FIGS. 8 and 10, the inner arms 130 have a rectangular tubular cross section defining two vertical sidewalls. The rod 220 extends through the vertical sidewalls and is welded in place, fixedly coupling the inner arms 130 together. The rod 220 has a substantially circular cross section and defines an aperture extending laterally therethrough. On each side of the lift assembly 14, a rod or pin 222 extends through an aperture defined by the outer arm 142 and an aperture defined by the inner arm 130 and is received within the aperture of the rod 220. The pins 222 pivotally couple the outer arms 142 and the inner arms 130 to the rod 220. A pin or fastener, shown as fastener 224, at least selectively fixes the pin 222 to the rod 220. The pin 222 may include a retaining ring (e.g., a snap ring, an E clip, etc.) or a machined shoulder that captures the outer arm 142, preventing it from moving laterally outward. The rod 220 extends substantially parallel to the end axis 152. In the embodiment shown in FIG. 8, the rod 220 is aligned with (e.g., centered about) the end axis 154.

An actuator (e.g., a hydraulic cylinder, a pneumatic cylinder, a motor-driven leadscrew, etc.), shown as lift actuator 240, is configured to extend and retract the lift assembly 14. As shown in FIG. 1, the lift assembly 14 includes one lift actuator 240, and the lift actuator 240 is a hydraulic cylinder fluidly coupled to the pump 46. The lift actuator 240 is pivotally coupled to the inner arms 110 at one end (e.g., a cap end) and pivotally coupled to the inner arms 130 at the opposite end (e.g., a rod end). In other embodiments, the lift assembly 14 includes more or fewer lift actuators 240 and/or the lift actuator 240 is otherwise arranged. The lift actuator 240 is configured to selectively reposition the lift assembly 14 between the fully extended and fully retracted positions. In some embodiments, extension of the lift actuator 240 moves the platform 16 vertically upward (extending the lift assembly 14), and retraction of the lift actuator 240 moves the platform 16 vertically downward (retracting the lift assembly 14). In other embodiments, extension of the lift actuator 240 retracts the lift assembly 14, and retraction of the lift actuator 240 extends the lift assembly 14. The lift device 10 may include various components configured to drive the lift actuator 240 (e.g., pumps, valves, compressors, motors, batteries, voltage regulators, etc.).

Referring to FIGS. 8-11, the lift device 10 includes a stabilizer, support member, or prop, shown as arm inspection prop 300. The arm inspection prop 300 is pivotally coupled to the rod 210 and selectively repositionable between a stowed position and a deployed position. In the stowed position, the arm inspection prop 300 is rotated down ward toward the center of the lift assembly 14 and permits downward movement of the platform 16. In the deployed position, the arm inspection prop 300 is rotated upward until it extends upward. The arm inspection prop 300 is then extends between the rod 210 and the rod 220, limiting downward movement of the rod 220. The arm inspection prop 300 supports the weight of the platform 16 and the top scissor layer 106, limiting the downward movement of the platform 16.

The arm inspection prop 300 includes a pair of panels, shown as side plates 302. The side plates 302 are laterally offset from one another. In some embodiments, the side plates 302 are substantially identical. The side plates 302 are coupled to one another by a series of structural members, shown as cross members 304. The cross members 304 extend laterally between the side plates 302 and are coupled (e.g., fastened, welded, etc.) to the side plates 302. As shown, the arm inspection prop 300 includes three cross members 304. In other embodiments, the arm inspection prop 300 includes more or fewer cross members 304. The cross members 304 maintain the spacing between the side plates 302 and prevent the side plates 302 from twisting relative to one another. An interface, shown as handle 306, is coupled to one of the cross members 304. The handle 306 is configured to facilitate manipulation (e.g., rotation) of the arm inspection prop 300 by an operator. Together, the side plates 302, the cross members 304, and the handle 306 form a main body of the prop 300. In some embodiments, all of the components of the main body are fixedly coupled to one another.

The arm inspection prop 300 further includes a pair of brackets (e.g., repositionable members, retaining members, repositionable members, secondary members, etc.), shown as retaining members 308. The retaining members 308 are each removably coupled (e.g., fastened, etc.) to one of the side plates 302 such that they are selectively repositionable relative to the side plates 302. An aperture, shown as retaining aperture 310, is defined between each side plate 302 and the corresponding retaining member 308. The retaining apertures 310 are aligned with one another along a lateral axis. The retaining apertures 310 each have a substantially circular cross section that is slightly larger than the diameter of the rod 210. The rod 210 is received within the retaining apertures 310, pivotally coupling the arm inspection prop 300 to the inner arms 120 and the outer arms 132. The arm inspection prop 300 rotates about a lateral axis centered along the rod 210. In the embodiment shown in FIG. 8, the arm inspection prop 300 rotates about the end axis 152. To remove the arm inspection prop 300 from the rod 210, the retaining member 308 may be removed (e.g., unfastened, etc.) from the side plates 302. Due to the removable nature of the retaining members 308, the arm inspection prop 300 can be easily removed for service. In other embodiments, the retaining members 308 are otherwise selectively repositionable relative to the side plates 302. By way of example, the retaining members 308 may be pivotally coupled to the side plates 302 and secured with a fastener such that they are selectively pivotally coupled to the side plates 302.

Figure 11:
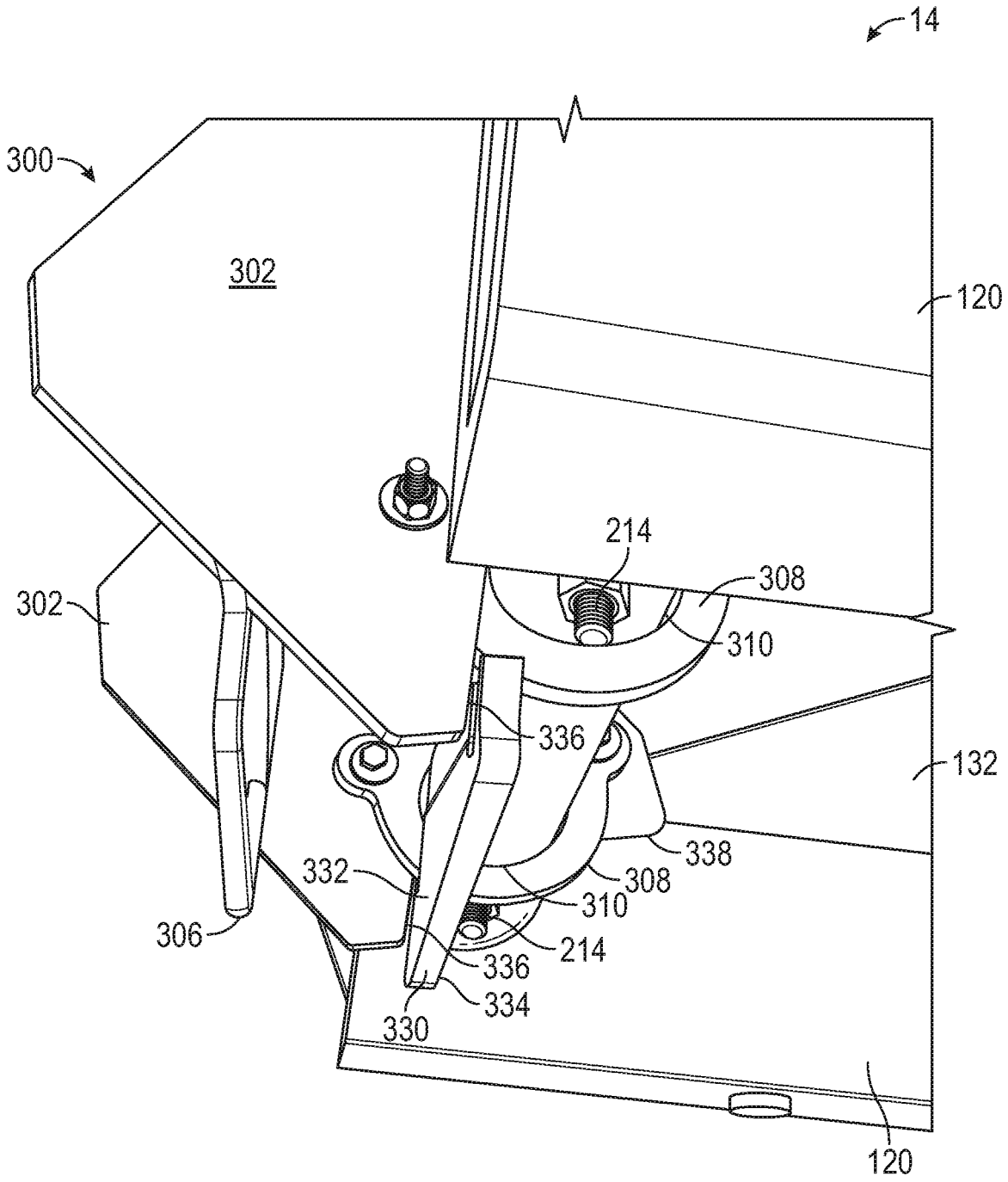
FIG. 11 is another perspective view of the arm inspection prop of FIG. 8 in the deployed position.

Referring to FIGS. 9 and 11, the lift assembly 14 further includes a plate, projection, protrusion, body, or member, shown as stop 330. The stop 330 is coupled (e.g., welded, fastened, etc.) to the rod 210. In one embodiment, the stop 330 is fixedly coupled to the rod 210, which is in turn fixedly coupled to the inner arms 120. The stop 330 engages the rod 210 between the retaining members 308 and between the side plates 302. A first portion of the stop 330, which engages the rod 210, has a first width $W_1$ measured laterally. A second portion of the stop 330, which is positioned farther from the rod 210 than the first portion, has a width $W_2$. The width $W_2$ is greater than the width $W_1$.

The width $W_1$ of the stop 330 is less than the lateral distance between the retaining members 308, facilitating placement of the stop 330 between the retaining members 308. The stop 330 limits lateral movement of the arm inspection prop 300. By way of example, if a lateral force were to be applied to the arm inspection prop 300 with the arm inspection prop 300 in the position shown in FIG. 9, one of the retaining members 308 would engage the side of the stop 330, preventing further lateral movement of the arm inspection prop 300. The width $W_1$ of the stop 330 and the distance between the retaining members 308 may be varied to adjust how much lateral movement the arm inspection prop 300 is permitted by the stop 330.

The width $W_2$ of the stop 330 is greater than the lateral distance between the side plates 302 such that the stop 330 engages the arm inspection prop 300 to limit rotation of the arm inspection prop 300 about the end axis 152. Specifically, the stop 330 defines a first engagement surface, shown as first stop surface 332, and a second engagement surface, shown as second stop surface 334. The first stop surface 332 and the second stop surface 334 are defined on opposite sides of the stop 330. In some embodiments, the first stop surface 332 and the second stop surface 334 are substantially parallel to one another. The first stop surface 332 is configured to engage a set of third engagement surfaces, shown as first prop surfaces 336, defined by the arm inspection prop 300 to limit rotation of the arm inspection prop 300 in a first direction. The second stop surface 334 is configured to engage a set of fourth engagement surfaces, shown as second prop surfaces 338, defined by the arm inspection prop 300 to limit rotation of the arm inspection prop 300 in a second direction opposite the first direction. Each side plate 302 defines one of the first prop surfaces 336 and one of the second prop surfaces 338. The contour of the first stop surface 332 matches the contour of the first prop surfaces 336. Similarly, the contour of the second stop surface 334 matches the contour of the second prop surfaces 338. By way of example, in the embodiment shown in FIG. 11, the first stop surface 332 and the first prop surfaces 336 are all flat, ensuring that full engagement and solid contact are maintained across the length of each engagement surface. By way of another example, if the first stop surface 332 were to have a convex curvature, the first prop surfaces 336 may have a corresponding curvature that fully engages the first stop surface 332.

In alternative embodiment, the stop 330 is an assembly including multiple separate bodies. In such an embodiment, a first body of the stop 330 may define the first stop surface 332 and a second body of the stop 330 may define the second stop surface 334. Additionally, the first stop surface 332 and/or the second stop surface 334 may be defined across multiple separate bodies. Accordingly, as used herein, the term "stop" may include a single body or multiple bodies.

Figure 12:
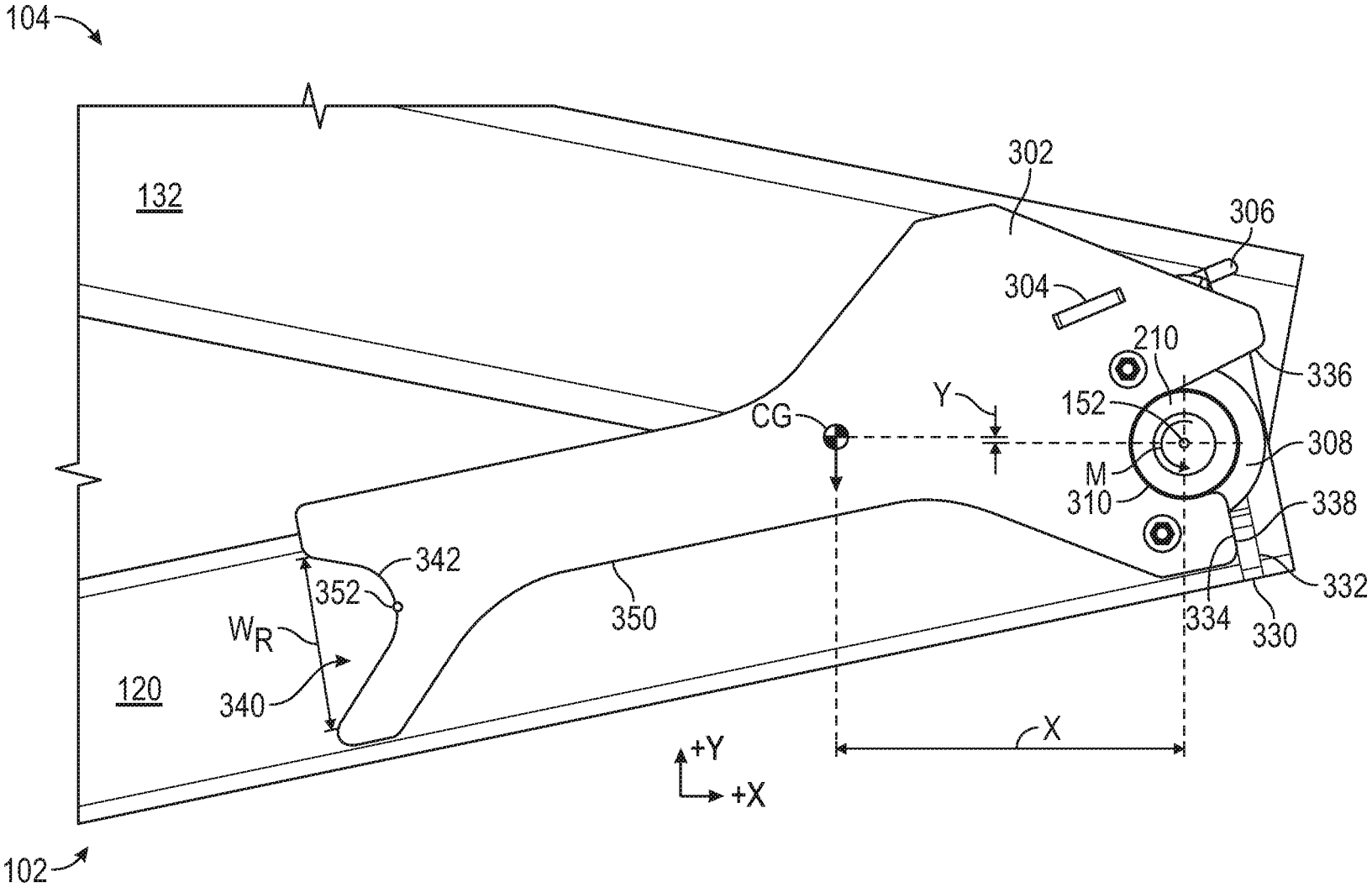
FIG. 12 is a side section view of the lift assembly of FIG. 5 showing the arm inspection prop of FIG. 8 in a stowed position.

Referring to FIGS. 10 and 12, the side plates 302 each further define a cutout, groove, or slot, shown as recess 340. The recess 340 is positioned at an end of the side plate 302 opposite the rod 210 and opens in a direction opposite the rod 210. The recesses 340 are configured to selectively receive the rod 220 such that the arm inspection prop 300 spaces the rod 210 away from the rod 220, preventing the lift assembly 14 from reaching the fully retracted position. The recess 340 has a width $W_R$ defined substantially perpendicular to a line extending within the plane of the side plate 302 between the deepest part of the recess 340 and the end axis 152. The width $W_R$ of the recess 340 is greatest at the opening or entrance to the recess (e.g., where the rod 220 first enters the recess 340) and gradually decreases toward the end axis 152. The width $W_R$ at the entrance of the recess 340 is greater than the width (e.g., diameter) of the rod 220. The increased width $W_R$ at the entrance of the recess 340 and the circular cross section of the rod 220 cause the arm inspection prop 300 to rotate, aligning the recess 340 with the rod 220 when the rod 220 is inserted into the recess 340. Along the edge of the recess 340, the side plates 202 each define an engagement surface, shown as recess surface 342. The recess surfaces 342 are configured to engage an engagement surface of the rod 320, shown as outer surface 344, when the rod 320 is fully seated within the deepest part of the recess 340. Additionally or alternatively, the recess surfaces 342 may be configured to engage an engagement surface of the inner arms 130.

Figure 13:
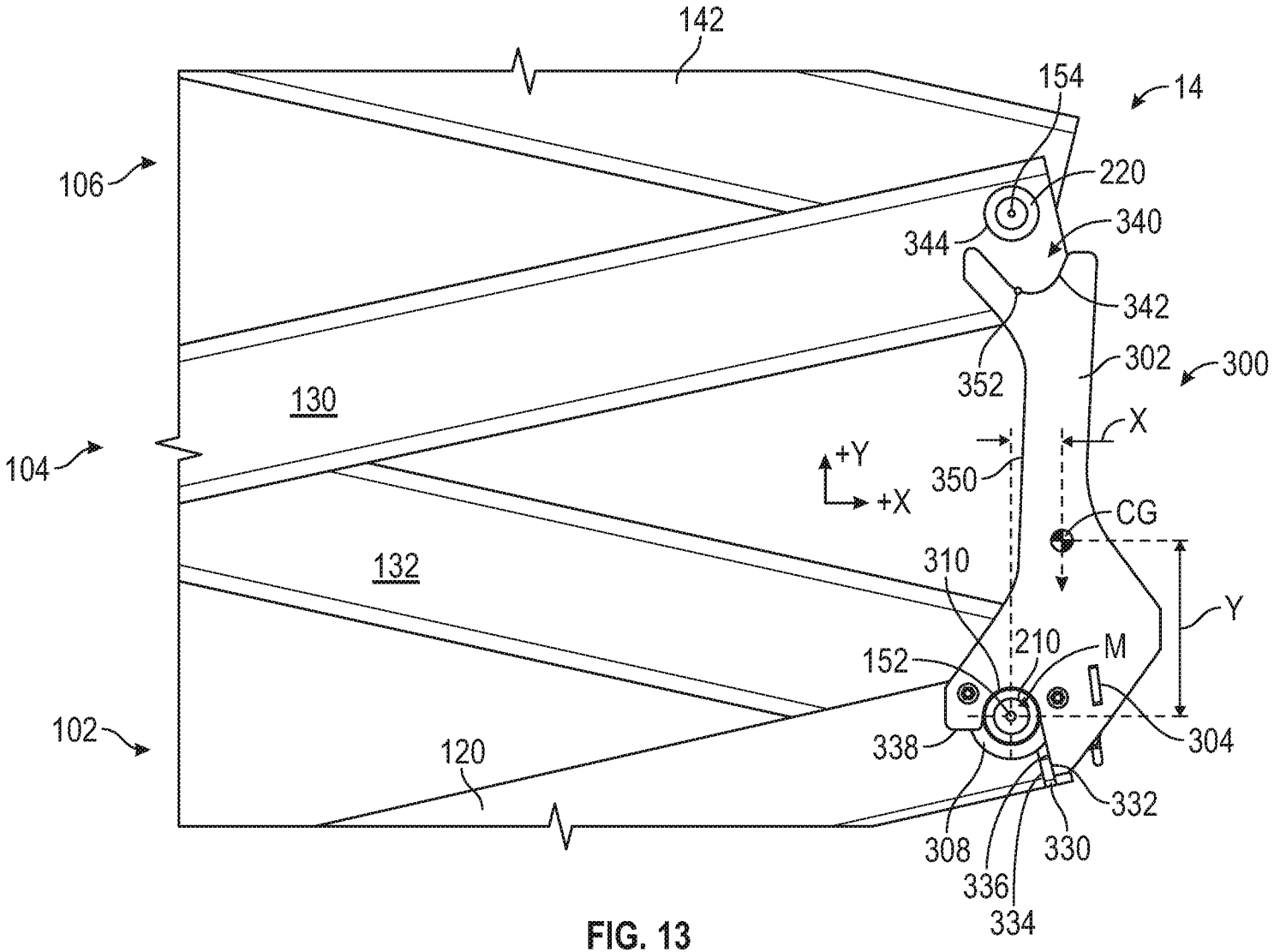
FIG. 13 is a side section view of the lift assembly of FIG. 5 showing the arm inspection prop of FIG. 8 in a deployed position.
Figure 14:
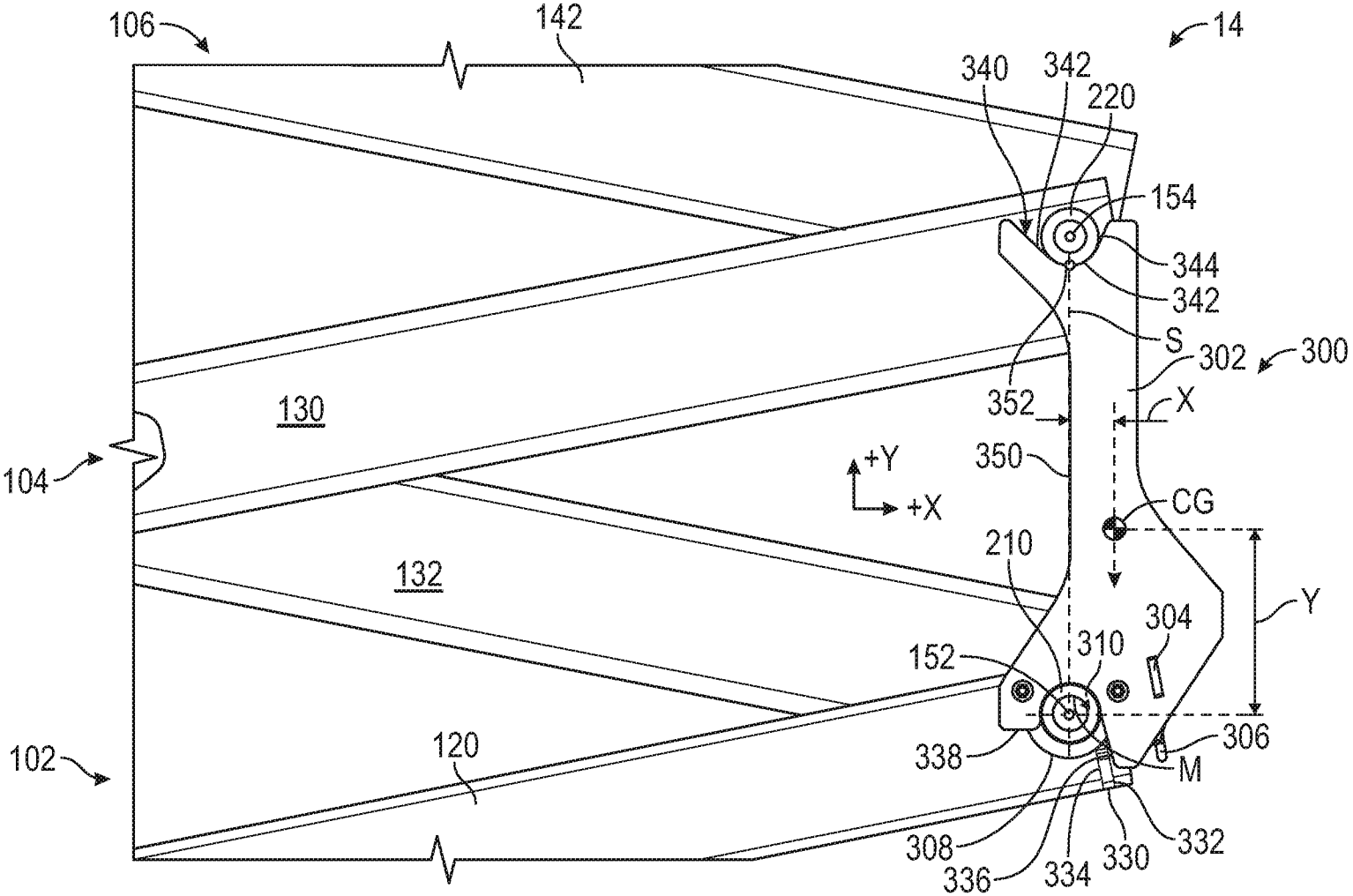
FIG. 14 is a side section view of the lift assembly of FIG. 5 showing the arm inspection prop of FIG. 8 in a loaded position.

Referring to FIGS. 12-14, the arm inspection prop 300 is selectively repositionable between a first, lowered, stored, or stowed position, shown in FIG. 12, and a second, raised, or deployed position, shown in FIG. 13. In the stowed position, the second stop surface 334 and the second prop surfaces 338 engage one another, and the side plates 302 extend along the inner arms 120. In the deployed position, the first stop surface 332 and the first prop surfaces 336 engage one another, and the side plates 302 extend substantially upward from the rod 210. The arm inspection prop 300 is further repositionable into a third or loaded position shown in FIG. 14. The loaded position is located between the stowed and deployed positions. Accordingly, while in the loaded position, the prop surfaces 336 and 338 do not engage the stop surfaces 332 and 334. The loaded position corresponds to the position where the outer surface 344 of the rod 220 fully engages the recess surface 342. The outer surface 344 fully engages the recess surface 342 when the rod 220 cannot move any lower within the recess 340 (e.g., is fully seated within the recess 340). Accordingly, the arm inspection prop 200 is in the loaded position when the rod 220 is fully seated within the recess 340 and the arm inspection prop 300 supports the platform 16.

The arm inspection prop 300 has a center of gravity, shown as CG. The position of the CG is described herein with reference to a longitudinal axis X and a vertical axis Y defined with respect to the frame assembly 12. A distance X is defined along the longitudinal axis X between the CG and the end axis 152, and a distance Y is defined along the vertical axis Y between the CG and the end axis 152. Gravity exerts a downward force on the CG, causing an effective moment M about the end axis 152. When the CG is positioned longitudinally inward of the end axis 152 (e.g., toward the center of the lift device 10, corresponding to a negative distance X), the effective moment M biases the arm inspection prop 300 toward the stowed position. When the CG is positioned longitudinally outward of the end axis 152 (e.g., away from the center of the lift device 10, corresponding to a positive distance X), the effective moment M biases the arm inspection prop 300 toward the deployed position.

The location of the CG may be varied by adjusting one or more parameters of the arm inspection prop 300. By way of example, the shapes of the side plates 202 may be varied. As shown in FIG. 14, the majority of the material forming the side plates 202 is positioned longitudinally outward of the end axis 152 when the arm inspection prop 300 is in the loaded position. This moves the CG longitudinally outward. By way of another example, the number and position of the cross members 304 may be varied. By way of yet another example, one or more weights may be added to the arm inspection prop 300 to adjust the position of the CG.

As shown in FIG. 12, in the stowed position the CG is positioned longitudinally inward of and vertically above the end axis 152. Accordingly, the force of gravity forces the second stop surface 334 against the second prop surfaces 338, holding the arm inspection prop 300 in place. Due to the biasing force of gravity, the arm inspection prop 300 will automatically return to the stowed position if the CG is positioned longitudinally inward of the end axis 152. To return the arm inspection prop 300 to the stowed position, an operator may simply apply an inward longitudinal force on the arm inspection prop 300 (e.g., by pushing on the side plates 302, etc.).

Figure 15:
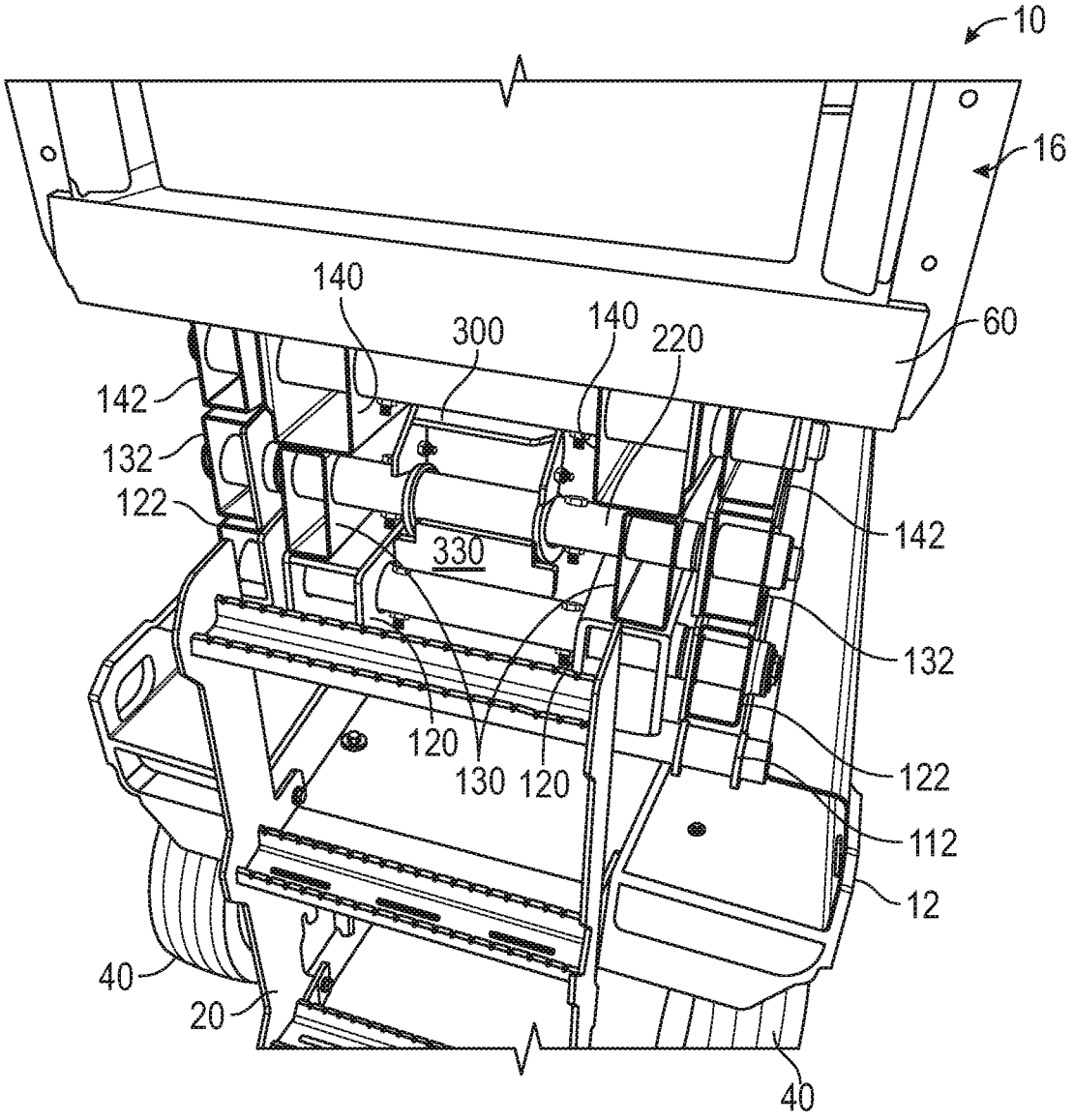
FIG. 15 is a perspective view of the lift assembly of FIG. 5 in a fully retracted position.

As shown in FIG. 13, in the deployed position the CG is positioned longitudinally outward of and vertically above the end axis 152. Accordingly, the force of gravity forces the first stop surface 332 against the first prop surfaces 336, holding the arm inspection prop 300 in place. Due to the biasing force of gravity, the arm inspection prop 300 will automatically return to the deployed position if the CG is positioned longitudinally outward of the end axis 152. To bring the arm inspection prop 300 to the deployed position, an operator may simply apply an outward longitudinal force on the arm inspection prop 300 (e.g., by pulling on the handle 306, etc.). When in the stowed position, the arm inspection prop 300 permits the platform 16 to reach the fully lowered position, shown in FIG. 15. As the arm inspection prop 300 is positioned between the inner arms 130, arm inspection prop 300 does not interfere with the inner arms 130.

As shown in FIGS. 13 and 14, when the arm inspection prop 300 is in the deployed position and the platform 16 is lowered (e.g., by controlling the lift actuator 240), the outer surface 344 of the rod 220 will automatically engage the recess surface 342. As the platform 16 is lowered further, the engagement between the rod 220 and the side plates 302 will force the arm inspection prop 300 to rotate toward the loaded position until the platform 16 is fully supported by the arm inspection prop 300 (e.g., the lift actuator 240 bears a negligible portion of the weight of the platform 16). Accordingly, the arm inspection prop 300 does not require the operator to remain in contact with the arm inspection prop 300 while the rod 220 is being lowered into the recess 340. Rather, an operator can simply place the arm inspection prop 300 into the deployed position and step away from the lift device 10, removing any potential for the operator to come into contact with a moving component of the lift device 10. This configuration also operation of the arm inspection prop 300 by a single user (i.e., a second operator is not necessary).

As shown in FIG. 14, in the loaded position, a straight line S can be drawn between the end axis 154 and the end axis 152. The force on the arm inspection prop 300 (e.g., the weight of the platform 16 and the top scissor layer 106) as a compressive force along the line S. As shown in FIG. 14, an edge 350 of the side plate 602 extends along the line S. The line S also extends through the deepest point of the recess 340, shown as point 352. The CG is positioned longitudinally outward of and vertically above the end axis 152. The CG is offset longitudinally outward from the line S. While the prop surfaces and stop surfaces are not in contact, engagement between the outer surface 344 and the recess surface 342 prevents the arm inspection prop 300 from rotating. If the lift assembly 14 is extended, the rod 220 will raise, and the force of gravity will automatically return the arm inspection prop 300 to the deployed position.

Figure 16:
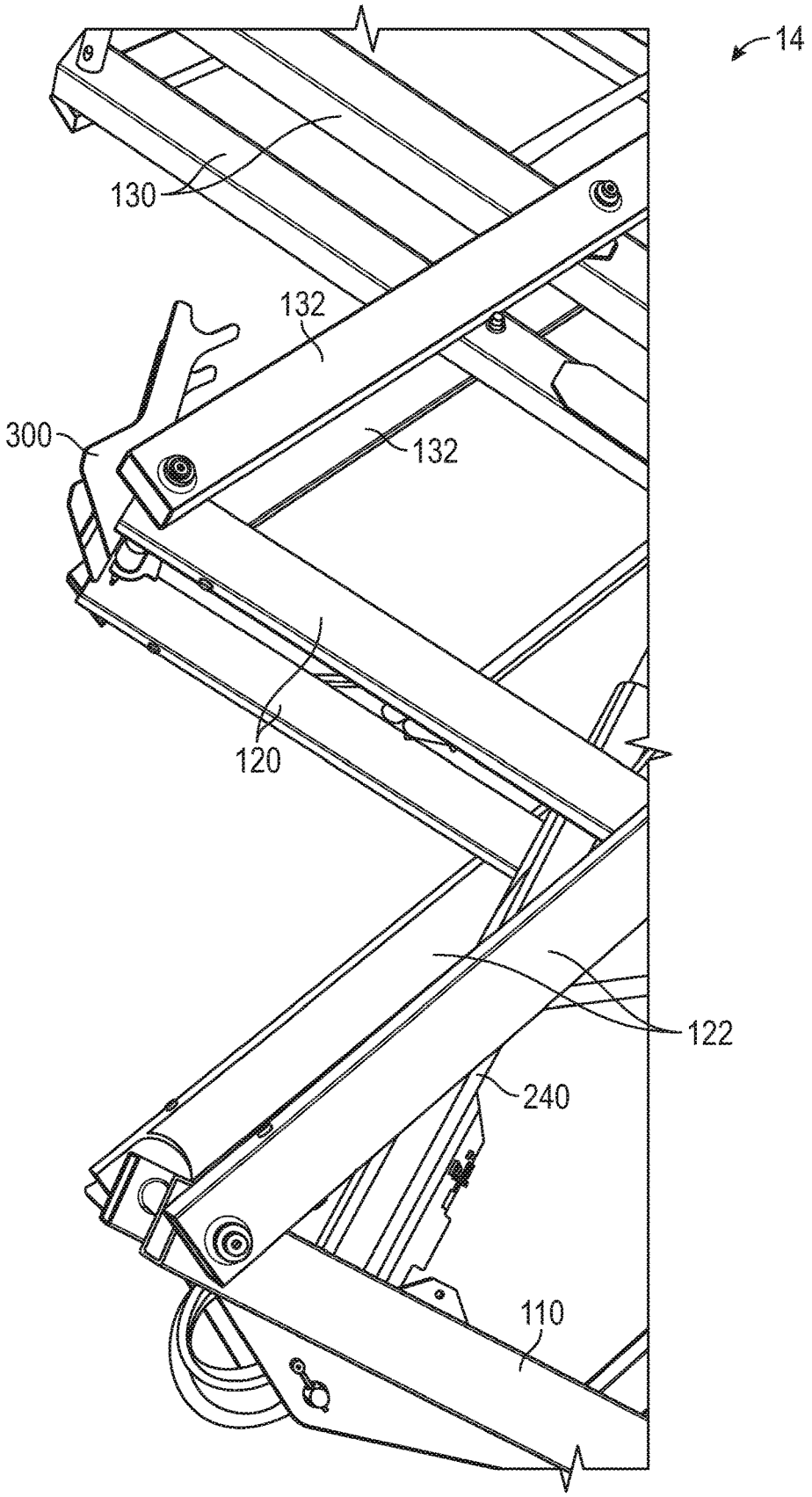
FIG. 16 is a perspective view of the lift assembly of FIG. 5 showing the arm inspection prop of FIG. 8 at a tipping point.

As the lift assembly 14 extends, the inner arms 120 and the stop 330 rotate. This changes the orientation of the arm inspection prop 300 relative to the direction of gravity in the stored and deployed positions. If the lift assembly 14 is extended above a threshold height, shown in FIG. 16, the arm inspection prop 300 reaches a tipping point. While the arm inspection prop 300 is in the deployed position at the tipping point, the CG is positioned directly above the end axis 152. If the lift assembly 14 continues to extend beyond the tipping point, the CG will move longitudinally inward of the end axis 152, and the force of gravity will cause the arm inspection prop 300 to fall into the stowed position. The arm inspection prop 300 is configured such that the tipping point occurs before the lift assembly 14 is fully extended. Accordingly, the arm inspection prop 300 automatically returns to the stowed position when the lift assembly 14 is extended above the threshold height.

As shown in FIGS. 9 and 11-13, the handle 306 is positioned to be easily accessible by an operator throughout its range of motion. In both the stowed and deployed positions, the handle 306 is directly accessible (e.g., not blocked by another component) by an operator positioned immediately behind the lift device 10. Accordingly, the operator does not have to reach into the lift device 10 to deploy the arm inspection prop 300. Additionally, the handle 306 is positioned entirely between the side plates 302. Accordingly, the handle 306 may be manipulated by an operator without the operator having to be concerned with pinching a finger between the side plates 302 and the stop 330.

The arm inspection prop 300 provides a variety of additional benefits. The arm inspection prop 300 permits an operator to hold the platform 16 and lift assembly 14 in place without the use of additional tools or devices that would have to be retrieved prior to use. Because the arm inspection prop 300 is coupled to the rod 210, the arm inspection prop 300 cannot be inverted and used in an undesirable orientation. Because the arm inspection prop 300 is centered laterally, the arm inspection prop 300 does not induce any undesirable moment loading that would be associated with supporting only side of the lift assembly 14.

Although the rod 210 and the rod 220 are shown herein as being positioned along the end axis 152 and the end axis 154, the rod 210 and the rod 220 may alternatively be coupled to any of the other adjacent lateral axes that are discussed herein. By way of example, the rod 210 and the rod 220 may be positioned along: the end axis 160 and the end axis 150; the end axis 170 and the end axis 150; the end axis 150 and the end axis 152; the end axis 154 and the end axis 180; or the end axis 154 and the end axis 190, respectively. The arm inspection prop 300 may be moved along with the rod 210 and the rod 220. When positioning the arm inspection prop 300, the accessibility of the arm inspection prop 300 to the operator may be taken into account. Additionally, when the arm inspection prop 300 is moved to a lower scissor layer, the arm inspection prop 300 may be configured to support larger forces, as the arm inspection prop 300 will be required to support the weight of additional scissor layers as well.

In further alternative embodiments, the rod 210 and/or the rod 220 are not positioned along any of the end axes. Rather, the rod 210 and/or the rod 220 may be offset relative to all of the end axes. In such embodiments, the arm inspection prop 300 may rotate about an axis that is not one of the end axes described herein. Additionally, in such embodiments, the recess surface 342 may be configured to engage an outer surface 344 of a component that is not aligned with one of the end axes.

In other embodiments, different parts of the lift assembly 14 are translationally fixed relative to the frame assembly 12 and/or the platform 16. By way of example, the end axis 160 may be free to translate relative to the frame assembly 12, and the end axis 170 may be fixed relative to the frame assembly 12. By way of another example, the end axis 180 may be free to translate relative to the platform 16, and the end axis 190 may be fixed relative to the platform 16.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

The invention claimed is:

1. A lift device, comprising:

a base;

a platform configured to support an operator; and a scissor assembly coupling the base to the platform, the scissor assembly including:

an actuator configured to extend and retract the scissor assembly to move the platform between a fully raised position and a fully lowered position;

a first scissor arm;

an assembly including a second scissor arm pivotally coupled to the first scissor arm and a protrusion coupled to the second scissor arm, the protrusion defining an engagement surface;

a prop pivotally coupled to the first scissor arm such that the prop rotates about a lateral axis; and a stop coupled to the first scissor arm and defining a stop surface, wherein the prop is configured to selectively engage the engagement surface, thereby preventing the platform from reaching the fully lowered position;

wherein the prop is selectively repositionable between:

a stowed position in which the prop does not engage the engagement surface when the platform is lowered;

a deployed position in which (a) the prop engages the engagement surface when the platform is lowered and (b) the prop engages the stop surface; and a loaded position between the stowed and deployed positions, wherein the prop is configured to be in the loaded position when the prop supports the platform, and wherein the prop is biased toward the deployed position when the prop is in the loaded position.

2. The lift device of claim 1, wherein the stop surface is a first stop surface, wherein the stop further defines a second stop surface, and wherein the prop is configured to engage the second stop surface to limit rotation of the prop when the prop is in the stowed position.

3. The lift device of claim 2, wherein the prop engages neither the first stop surface nor the second stop surface when the prop is in the loaded position.

4. The lift device of claim 1, wherein a center of gravity of the prop is positioned longitudinally outward from the lateral axis when the prop is in the deployed position such that the prop is biased toward the deployed position by gravity.

5. The lift device of claim 4, wherein the center of gravity of the prop is positioned longitudinally inward from the lateral axis when the prop is in the stowed position such that the prop is biased toward the stowed position by gravity.

6. The lift device of claim 5, wherein the center of gravity of the prop is positioned longitudinally outward from the lateral axis when the prop is in the loaded position such that the prop is biased toward the deployed position by gravity.

7. The lift device of claim 1, wherein the first scissor arm is pivotally coupled to one of the base and a third scissor arm extending between the first scissor arm and the base, and wherein the first scissor arm is configured to rotate relative to the one of base and the third scissor arm about the lateral axis.

8. The lift device of claim 7, wherein the engagement surface is defined by the protrusion, wherein the protrusion extends along a second lateral axis, wherein the second scissor arm is pivotally coupled to one of the platform and a fourth scissor arm extending between the second scissor arm and the platform, and wherein the second scissor arm is configured to rotate relative to the one of the platform and the fourth scissor arm about the second lateral axis.

9. The lift device of claim 1, wherein the protrusion is a first rod coupled to the second scissor arm and extending along a second lateral axis, wherein the rod defines the engagement surface, wherein the prop defines a recess configured to receive the rod through an opening, wherein a width of the recess is greatest at the opening.

10. The lift device of claim 1, wherein the engagement surface is positioned above the lateral axis such that the prop extends upward from the lateral axis when the prop engages the engagement surface.

11. The lift device of claim 1, wherein the scissor assembly further includes:

a third scissor arm fixedly coupled to the first scissor arm and pivotally coupled to the second scissor arm; and a second rod coupled to the first scissor arm and the third scissor arm and extending along the lateral axis, wherein the first scissor arm and the third scissor arm are configured to rotate relative to the second scissor arm about a middle axis, and wherein the prop is pivotally coupled to the second rod.

12. The lift device of claim 11, wherein the prop includes a main body at least selectively coupled to a retaining member, the main body and the retaining member defining a retaining aperture therebetween, wherein the retaining aperture is configured to receive the second rod to pivotally couple the prop to the second rod, and wherein the retaining member is selectively repositionable relative to the main body to permit removal of the second rod from the retaining aperture.

13. The lift device of claim 1, wherein the prop is biased toward the deployed position by gravity when the prop is in the loaded position.

* * * * *